United States Patent [19]

Shibuya

[11] Patent Number: 4,522,573

[45] Date of Patent: Jun. 11, 1985

[54] VARIABLE DELIVERY VANE COMPRESSOR

[75] Inventor: Tsunenori Shibuya, Konan, Japan

[73] Assignee: Diesel Kiki Co., Ltd., Tokyo, Japan

[21] Appl. No.: 556,024

[22] Filed: Nov. 29, 1983

[30] Foreign Application Priority Data

Dec. 6, 1982 [JP] Japan ..... 57-213710

[51] Int. Cl.[3] ..... F04C 18/00; F04C 29/10

[52] U.S. Cl. ..... 418/23; 418/158

[58] Field of Search ..... 418/23, 158, 253

[56] References Cited

U.S. PATENT DOCUMENTS 4,050,263 9/1977 Adalbert et al. ..... 418/23

FOREIGN PATENT DOCUMENTS 3101516 8/1982 Fed. Rep. of Germany ..... 418/23

41750 1/1933 France ..... 418/23

*Primary Examiner*—John J. Vrablik

*Attorney, Agent, or Firm*—Frishauf, Holtz, Goodman & Woodward

[57] ABSTRACT

In a vane compressor wherein at least two spaces are defined between a pump housing and a rotor disposed within the pump housing, for defining pump working chambers in cooperation with vanes carried in slits in the rotor, each of the vanes has an axial end edge provided with engaging means. Arresting means is disposed for engagement and disengagement with the engaging means of the vanes. When the arresting means is in a position engaging with the engaging means, it arrests each of the vanes in a retracted position in the vane slit in the rotor, while the vane is circumferentially moving in at least one of the pump working chamber-defining spaces from a pump inlet opening in the same space to a pump outlet opening in the same space.

6 Claims, 8 Drawing Figures

VARIABLE DELIVERY VANE COMPRESSOR

BACKGROUND OF THE INVENTION

This invention relates to variable delivery vane compressors which have variable delivery quantities, and more particularly to a variable delivery vane compressor adapted for use in an air conditioning system for vehicles, which is adapted to have its delivery quantity of compressed refrigerant varied in response to operating conditions of a vehicle engine which drives the compressor.

A compressor used in an air conditioning system for automotive vehicles is generally driven by the engine of an automotive vehicle in which the air conditioning system is installed. The engine of the automotive vehicle, however, usually operates at various speeds from a low speed region such as idling to a high speed region. Since a compressor for air conditioning is required to exhibit satisfactory cooling performance even when the vehicle engine is operating in the low speed region, the capacity of the compressor, i.e. the delivery quantity of refrigerant per rotation is set to a somewhat large value so as to meet such requirement. This, however, results in an excessive cooling capacity of the air conditioning system as well as large power consumption of the engine during operation of the engine in the high speed region, that is, a large loss of energy. To avoid this disadvantage, an electromagnetic clutch has conventionally been employed for driving connection between the engine and the compressor. The clutch is disengaged to disconnect the compressor from the engine when a sensed discharge air temperature is below a predetermined value.

However, according to this conventional measure, at high air temperatures, the clutch is repeatedly engaged and disengaged with high frequency, which causes frequent changes in the load on the engine, giving a discomfortable feeling to the driver.

To overcome this drawback, a cooling system in an automotive vehicle has been proposed by U.S. Pat. No. 4,050,263 which employs a vane compressor adapted to reduce the refrigerant delivery quantity, i.e. perrotation volumetric throughput of the compressor in response to the rotational speed of the engine by arresting two diametrically opposite vanes in the retracted position when the engine is operating in a low or medium speed region.

However, according to this proposed compressor, the means for arresting the vanes in the retracted position has rather a complicated structure. Further, the arresting means is arranged within the rotor at a central portion thereof, requiring formation of a largesized internal space in the interior of the rotor for accommodating the arresting means, which imposes limitations upon the design of the compressor and also making it difficult to design the compressor compact in size.

SUMMARY OF THE INVENTION

It is an object of the invention to provide a variable delivery vane compressor which is capable of varying its delivery quantity or per-rotation volumetric throughput without having its rotation interrupted or resumed, thereby minimizing changes in the load on a prime mover for driving the compressor, such as an automotive engine.

It is a further object of the invention to provide a variable delivery vane which is simple in structure and can be arranged compact in size.

It is another object of the invention to provide a variable delivery vane compressor with high versatility which can be used in various kinds of apparatuses.

The present invention provides a variable delivery vane compressor having a pump housing, a rotor rotatably received within the pump housing, and a plurality of vanes slidably fitted in as many axial slits formed in the outer peripheral surface of the rotor. At least two spaces are defined between the pump housing and the rotor, for defining pump working chambers in cooperation with adjacent vanes. Each of the vanes has one axial end edge provided with engaging means. Arresting means is disposed for selective engagement and disengagement with and from the engaging means of each of the vanes. The arresting means is controlled by control means to selectively assume a first position engaging with the engaging means in which it arrests each of the vanes in a retracted position in a corresponding one of the above slits while the same vane is circumferentially moving in at least one of the above pump working chamber-defining spaces from a pump inlet opening in the same space to a pump outlet opening in the same space, and a second position disengaged from the engaging means in which it allows each of the vanes to slide on the camming inner peripheral surface of the pump housing while the same vane is circumferentially moving in the at least one pump working chamber-defining space.

The above and other objects, features and advantages of the invention will be more apparent from the ensuing detailed description taken in conjunction with the accompanying drawings.

DETAILED DESCRIPTION

Figure 1:
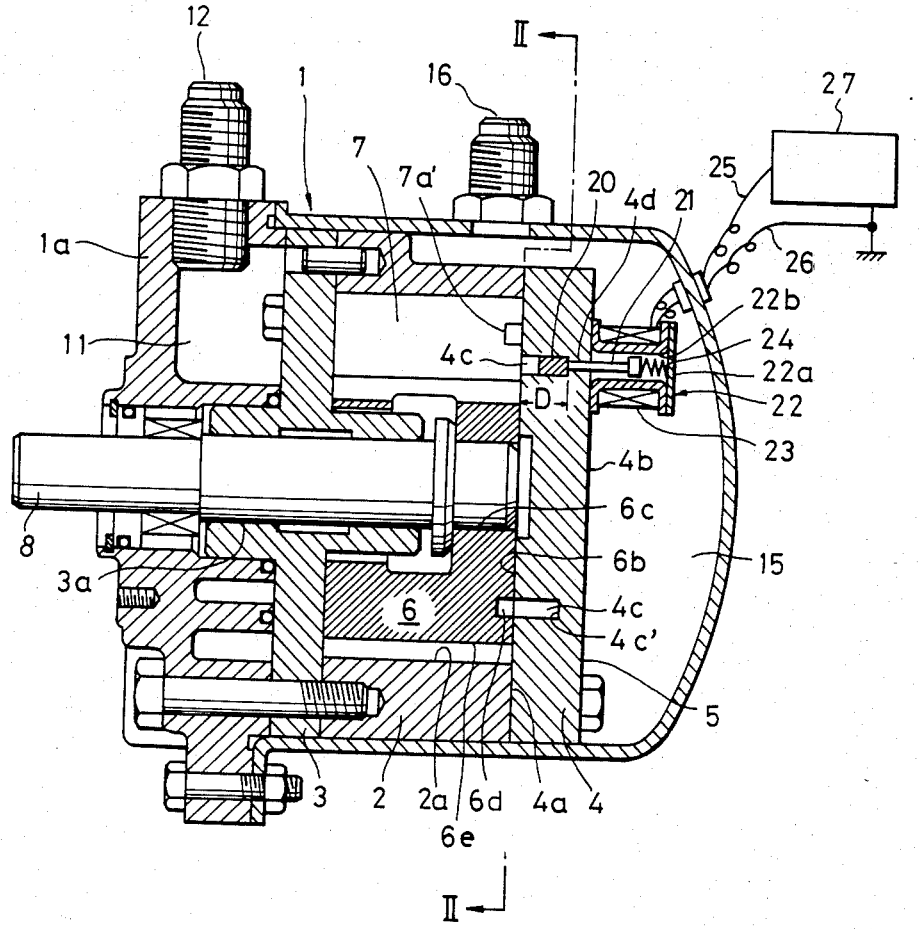
FIG. 1 is a longitudinal sectional view of a variable delivery, vane compressor according to an embodiment of the invention.

FIGS. 1 through 7 show an embodiment of the invention which is applied to a vane compressor of the type having two pump working chamber-defining spaces at diametrically opposite locations. Arranged within a casing 1 is a pump housing 5 which comprises a cam ring 2 having a substantially ellipsoidal configuration and having its inner peripheral surface 2*a* serving as an endless camming surface, and front and rear side blocks 3 and 4 secured to opposite open ends of the cam ring 2. A cylindrical rotor 6 is rotatably received within the pump housing 5. The rotor 6 has its outer peripheral surface 6e formed with a plurality of (four in the illustrated embodiment) axial slits 6a at circumferentially equal intervals, in each of which is radially slidably fitted a plate-like vane 7. The rotor 6 is concentrically rigidly fitted at its axial bore 6c on an end portion of a drive shaft 8 which rotatably supportedly extends through a bearing portion 3a formed integrally with the front side block 3. Two spaces 9 and 10, which define pump working chambers 9' and 10' between adjacent vanes 7, 7 in cooperation therewith, are defined between the outer peripheral surface 6e of the rotor 6 and the camming inner peripheral surface 2a of the cam ring 2. Pump working chambers 9', 10' on the suction stroke communicate with a suction chamber 11 formed within a front head 1a, through pump inlets 9a and 10a formed through the cam ring 2. The suction chamber 11 communicates with an external refrigerating circuit, not shown, through the interior of a suction connector 12. Pump working chambers 9', 10' on the discharge stroke can communicate with a discharge pressure chamber 15 defined between an outer peripheral surface of the cam ring 2, an end portion of the rear side block 4 remote from the front head 1a and the casing 1, through pump outlets 9b and 10b formed through the cam ring 2 and provided with discharge valves 13 and 14. The discharge pressure chamber 15 communicates with the external refrigerating circuit, through the interior of a discharge connector 16 provided in an upper portion of the casing 1.

Figure 2:
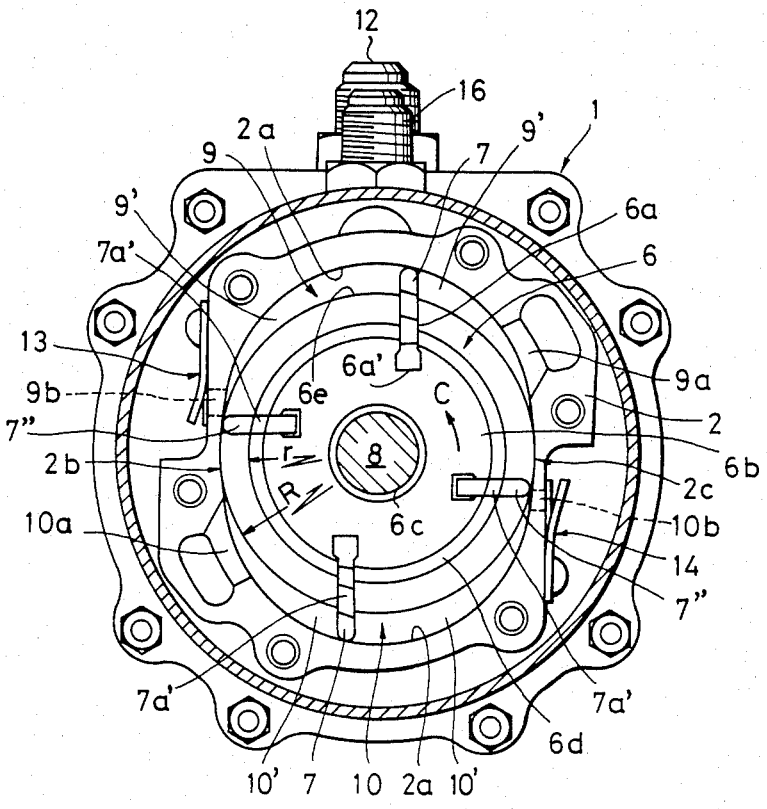
FIG. 2 is a transverse sectional view taken along line II—II in FIG. 1.
Figure 3:
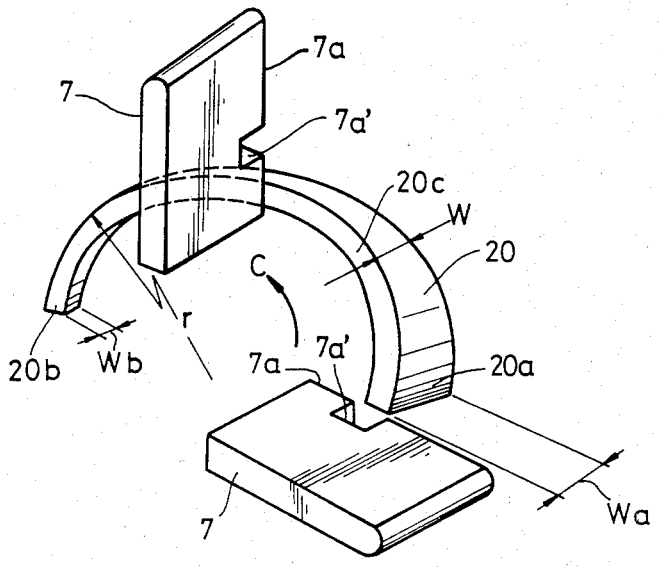
FIG. 3 is a perspective view of vanes and a holder shown in FIG. 1.

As shown in FIG. 2, the rotor 6 has its one end face 6b formed with an annular groove 6d disposed concentrically of the axial bore 6c, and circumferentially extending at a nearly radially middle location between a bottom surface 6a' of each slit 6a and the outer peripheral surface 6e of the rotor 6. On the other hand, an annular groove 4c is formed in an end face 4a of the rear side block 4 facing the end face 6b of the rotor 6 and aligned with the annular groove 6d of the rotor 6. As best shown in FIG. 3, a notch 7a' is formed in an axial end edge 7a of each of the vanes 7 located in an axial end of its slit 6a opening in the end face 6b of the rotor 6. The notch 7a' is located at such a radial location that it aligns with the annular groove 6d of the rotor 6 when the vane 7 is in a most retracted position in the slit 6a, as shown by reference numeral 7" in FIG. 2.

Figure 6:
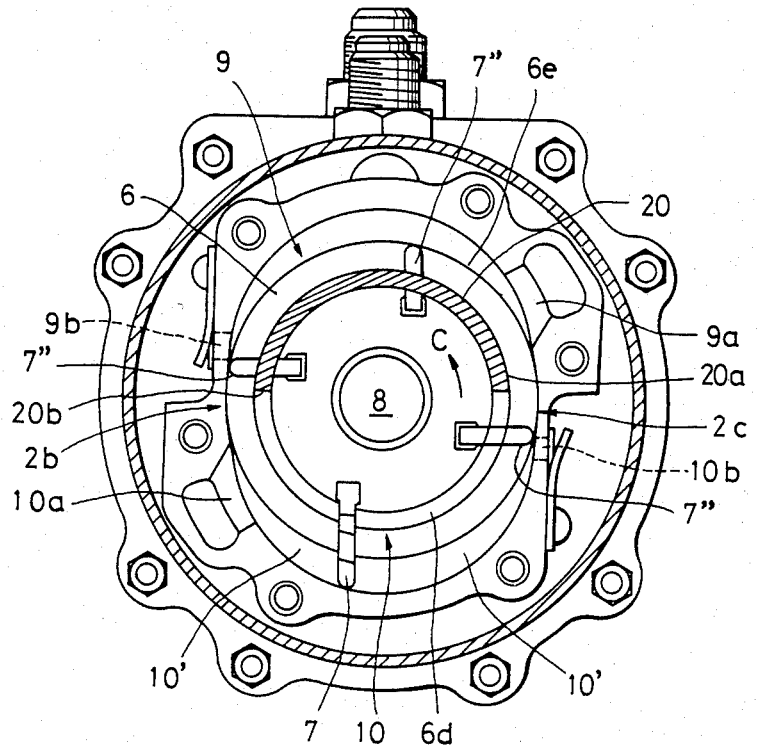
FIG. 6 is a transverse sectional view taken along line VI—VI in FIG. 5.

A holder 20 is provided which has a semi-circular configuration as shown in FIG. 3, and has the same radius r as those of the annular grooves 6d, 4c in the rotor 6 and the rear side block 4. The holder 20 has a tapered configuration in such a manner that the width Wa of one end portion 20a thereof is larger than the width Wb of the other end portion 20b, the width gradually decreasing from the one end portion 20a toward the other end portion 20b. The width Wa of the one end portion 20a is slightly larger than the depth D of the annular groove 4c (FIG. 1). This holder 20 is axially displaceably fitted in the annular groove 4c and circumferentially extends along an upper half of the circumference of the annular groove 4c, as shown in FIGS. 1 and 6.

The opposite end portions 20a, 20b of the holder 20 terminate in diammetrically opposite face-to-face contacting portions 2b, 2c of the camming inner peripheral surface 2a of the cam ring 2 with the outer peripheral surface 6e of the rotor 6 at nearly circumferentially middle locations between the pump inlet 9a opening in the pump working chamber-defining space 9 and the pump outlet 10b opening in the other pump working chamber-defining space 10 and adjacent to the pump inlet 9a at an upstream side thereof in the rotating direction of the rotor 6, and between the pump outlet 9b opening in the space 9 and the pump inlet 10a opening in the space 10 and adjacent to the pump outlet 9b at a downstream side thereof in the rotating direction of the rotor 6.

Figure 5:
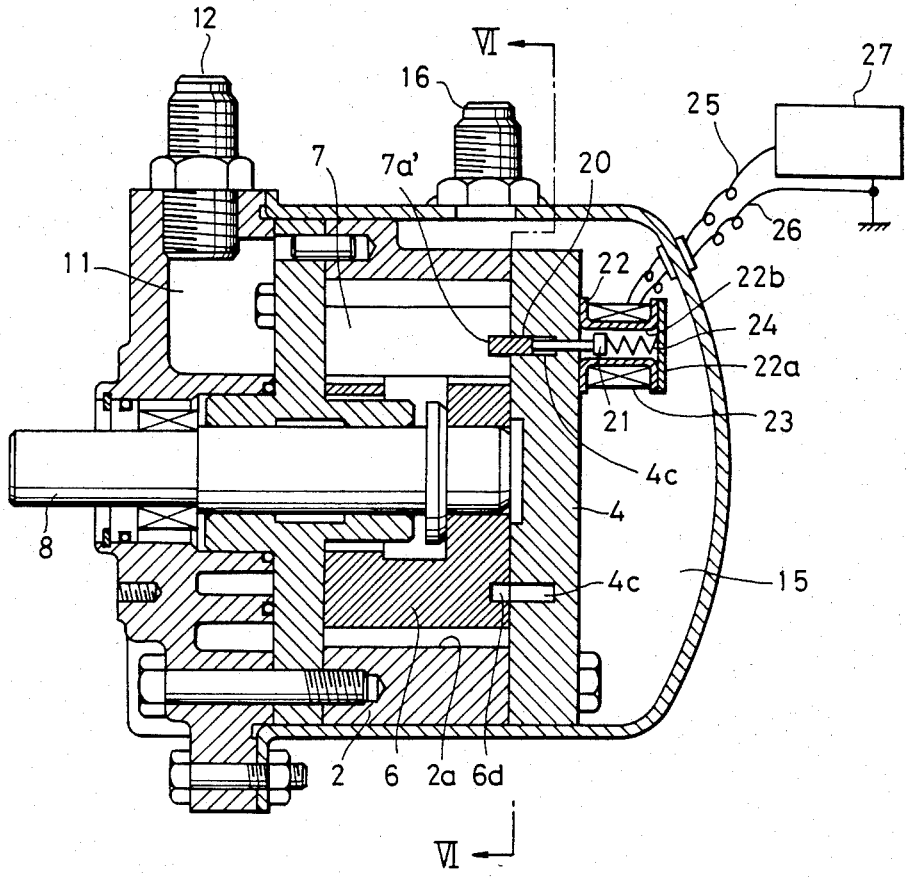
FIG. 5 is a view similar to FIG. 1, wherein the vanes are in a position engaging with the holder.

As shown in FIG. 1, the rear side block 4 is formed therein with an axial hole 4d at a location corresponding to a circumferentially central portion of the upper circumferential half of the annular groove 4c. The axial hole 4d opens at one end in a bottom face 4c' of the groove 4c and at the other end in an end face 4b of the rear side block 4 remote from the rotor 6, respectively. Axially movably fitted through the hole 4d is a rod 21 formed of a magnetic material, which has one end secured to an opposed lateral side edge of the holder 20 for movement therewith. Secured on the above end face 4b of the rear side block 4 is an annular support 22 formed of a non-magnetic material and disposed concentrically of the axial hole 4d in the rear side block 4. A solenoid 23 is wound on the annular support 22. Another end portion of the rod 21 is loosely fitted in a central hole 22b of the annular support 22. A compression coiled spring 24 is interposed between an end face of the rod 21 and an opposed end wall 22a of the annular support 22 and urges the rod 21 toward the open lateral side edge of the annular groove 4c. The above end wall 22a of the annular support 22 is formed of a magnetic material. When the solenoid 23 is in a deenergized state, the rod 21 is biased by the coiled spring 24 to hold the holder 20 in a position partly projected from the annular groove 4c and partly fitted into the opposed annular groove 6d of the rotor 6, as shown in FIG. 5. On the other hand, when the solenoid 23 is in an energized state, the rod 21 formed of a magnetic material is magnetically drawn by the solenoid 23 into the central hole 22b of the annular support 22 against the force of the coiled spring 24 to pull the holder 20 into the annular groove 4c, as shown in FIG. 1. The solenoid 23 is electrically connected to an electronic control unit 27 by means of connecting wires 25 and 26. The electronic control unit 27 is operative in response to the rotational speed of an engine for instance, which is drivingly connected to the drive shaft 8 of the compressor, to energize and deenergize the solenoid 23.

Figure 4:
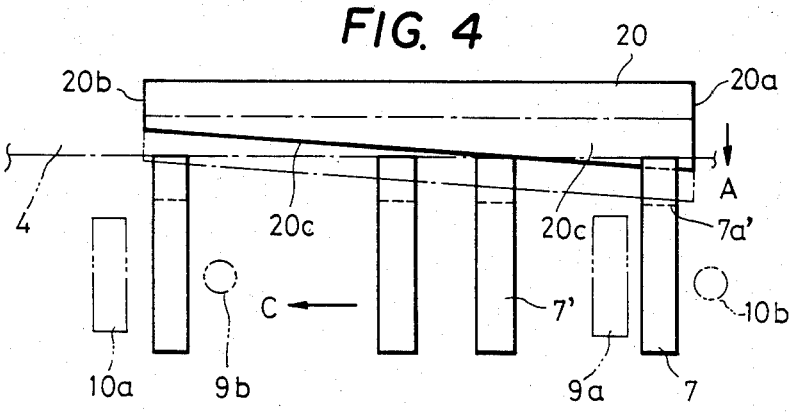
FIG. 4 is a view showing a manner of engagement and disengagement of the vanes from the holder with the holder shown in an unfolded state.

The operation of the vane compressor constructed as above will now be described. When the solenoid 23 is in an energized state, the holder 20 is retracted in the annular groove 4c, that is, in the position in FIG. 1. On this occasion, the lateral side edge 20c (FIGS. 3 and 4) of the end portion 20a of the holder 20 is slightly projected from the annular groove 4c and fitted in the annular groove 6d of the rotor 6 as well as in the notch 7a' of a vane 7. As the rotor 6 rotates in the direction indicated by the arrow C in FIGS. 2 and 4, each of the vanes 7 is kept in its retracted position in its slit 6a due to its sliding contact with the face-to-face contacting portion 2b (2c) of the cam ring 2 from the time it has passed the pump outlet 9b (10b) opening in the pump working chamber-defining space 9 (10) to the time it reaches the pump inlet 10a (9a). As shown in FIG. 4, at a nearly middle location between the pump outlet 10b and the pump inlet 9a, the notch 7a' of the vane 7 is slightly engaged with the lateral side edge 20c of the end portion 20a of the holder 20. Since the lateral side edge 20c of the holder 20 is tapered as previously noted, by the time the vane 7 has moved to a circumferential position indicated by numeral 7′ in FIG. 4 just past the pump inlet 9*a* opening in the pump working chamber-defining space 9, its notch 7*a*′ is already disengaged from the holder 20 which is in the retracted position in the annular groove 4*c*. Then, the vane 7 is radially outwardly pushed from the slit 6*a* into urging and sliding contact with the camming inner peripheral surface 2*a* due to centrifugal force produced by the rotating rotor 6 and back pressure of pressurized oil at the bottom face 6*a*′ of the slit 6*a* acting upon the vane 7.

As the rotor 6 further rotates, the fluid sucked into each pump working chamber 9′ is compressed and discharged into the discharge pressure chamber 15 through the pump outlet 9*b*. In this way, the vanes 7 cooperate with the camming inner peripheral surface 2*a* and the outer peripheral surface 6*e* of the rotor 6 to define pump working chambers 9′ to perform normal compressing actions in the same chambers, without being kept in their retracted positions in their slits 6*a*. It will be understood that the vanes also define pump working chambers 10′ to perform compressing actions therein and discharge compressed fluid or refrigerant through the pump outlet 10*b*. In this way, the compressor performs dual simultaneous compressing actions in two pump working chambers 9′, 10′.

When the solenoid 23 is deenergized, as shown in FIG. 5, the holder 20 is pushed by the force of the spring 24 in the direction indicated by the arrow A in FIG. 4 to be axially displaced away from the annular groove 4*c* into the annular groove 6*d* of the rotor 6 as in a position indicated by the chain line in FIG. 4. In this position, when each of the vanes 7 reaches the face-to-face contacting portion 2*c* as the rotor 6 rotates as shown at vane positions 7″ in FIG. 6, the vane 7 is brought into the most retracted position in its slit 6*a* so that its notch 7*a*′ aligned with the annular groove 6*d* becomes fitted onto the lateral side edge 20*c* of the holder 20. Since the holder 20 is fitted in the annular groove 6*d* of the rotor 6 along an upper half of the circumference of the rotor 6 positionally corresponding to the pump working chamber-defining space 9, the notch 7*a*′ of the vane 7 is kept engaged with the holder 20 as indicated by the chain line in FIG. 4 from the time the vane 7 circumferentially moves from the suction-starting position to the discharge-completing position, that is, between the two opposite face-to-face contacting portions 2*b*, 2*c* of the cam ring 2. Thus, each of the vanes 7 is kept in the retracted position in its slit 6*a* as shown at vane positions 7″, while revolving along the holder 20 about the drive shaft 8. Consequently, no pump working chamber 9′ is defined as in FIG. 2 by the vanes 7 within the space 9, thus suspending compression actions.

For instance, if the solenoid 23 is deenergized when the vanes 7 assume a rotational position illustrated in FIG. 2, the holder 20 is axially displaced by the force of the spring 24. On this occasion, however, the radially outwardly projected vane 7 in the upper half of the circumference of the rotor 6, i.e., the uppermost vane 7 in FIG. 2, does not engage at its notch 7*a*′ with the lateral side edge 20*c* of the holder 20, since the lateral side edge 20*c* of the holder 20 is then in contact with the axial end edge 7*a* of the uppermost vane 7. Therefore, the holder 20 assumes a position intermediate the fully retracted position indicated by the solid line in FIG. 4, and the axially projected maximum position indicated by the chain line in the same figure. Since the holder 20 has a tapered configuration as stated above, the holder 20 is gradually axially displaced by the force of the spring 24 toward the axially projected maximum position with continued rotation of the uppermost vane 7 from the position of FIG. 2 upon further rotation of the rotor 6. When the uppermost vane 7 in FIG. 2 reaches a location in the vicinity of the face-to-face contacting portion 2*b*, its notch 7*a*′ becomes engaged with the lateral side edge 20*c* of the holder 20. Thereafter, so long as the solenoid 23 is deenergized, the holder 20 is held in the axially projected maximum position and, accordingly, each vane 7 is kept retracted in its slit 6*a* as it travels along the upper half of the circumference of the rotor 6 positionally corresponding to the pump working chamber-defining space 9.

When each of the vanes 7 further circumferentially moves or rotates about the drive shaft 8 over the pump outlet 9*b* opening in the space 9 and past the end portion 20*b* of the holder 20, the notch 7*a*′ becomes disengaged from the holder 20. Thereafter, the vane 7 is kept in sliding contact with the camming inner peripheral surface 2*a* as usual as it travels along a lower half of the circumference of the rotor 6, whereby pump working chambers 10′ are defined in the pump working chamber-defining space 10 by adjacent vanes 7 in cooperation with the camming inner peripheral surface 2*a* and the outer peripheral surface 6*e* of the rotor 6, in which chambers fluid compressing actions are carried out. In this way, during one rotation of the rotor 6, the fluid compressing action is effected by the vanes while they are travelling in the pump working chamber-defining space 10 along the lower half of the circumference of the rotor 6, while no fluid compressing action is effected while the vanes are travelling in the pump working chamber-defining space 9 along the upper half of the circumference of the rotor. Accordingly, the delivery quantity or per-rotation volumetric throughput of the compressor is half of the full delivery quantity. This variable delivery quantity control is possible irrespective of the number of vanes used in the compressor, because individual ones of the vanes are arrested in their retracted positions in their slits independently of the other vanes. Therefore, although in the illustrated embodiment four vanes are used, the invention may be applied to a vane compressor having any other number of vanes.

Figure 7:
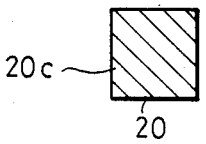
FIG. 7 is a sectional view of an example of the sectional configuration of the holder in FIG. 1.
Figure 8:
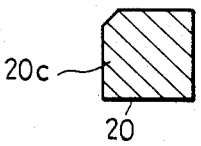
FIG. 8 is a sectional view of another example of the sectional configuration of the holder 4.

The lateral side edge 20*c* of the holder 20 to be fitted on the notch 7*a*′ of each vane 7 is configured with angular edges as shown in FIG. 7. Alternatively, as shown in FIG. 8, the lateral side edge 20*c* may be chamfered by cutting off part of one of the edges so as to allow smooth fitting of the lateral side edge 20*c* into the notch 7*a*′ of each vane 7.

Further, the means for controlling the axial position of the holder 20 may alternatively be arranged to operate such that energization of a solenoid corresponding to the solenoid 23 causes axial displacement of the holder 20 into the annular groove 6*d* away from the annular groove 4*c*, while deenergization of the solenoid causes receding of the holder 20 into the annular groove 4*c*, in a manner contrary to the embodiment described above.

Obviously many modifications and variations of the present invention are possible in the light of the above disclosure. It is therefore to be understood that within the scope of the appended claims the invention may be practiced otherwise than as specifically described.

What is claimed is:

1. A variable delivery vane compressor comprising:

a cam ring having an endless camming inner peripheral surface and opposite open ends;

a pair of front and rear side blocks secured to said opposite open ends of said cam ring and cooperating with said cam ring to define a pump housing, said pump housing having at least two pump inlets and at least two pump outlets;

a rotor rotatably received within said pump housing and having an outer peripheral surface formed with a plurality of axial slits, said rotor cooperating with said pump housing to define at least two spaces for forming pump working chambers, one of said pump outlets and one of said pump inlets opening in each of said spaces;

a plurality of vanes radially slidably fitted, respectively, in said axial slits in said rotor for sliding contact with said camming inner peripheral surface of said cam ring, adjacent ones of said vanes cooperating with said pump housing and said rotor to define said pump working chambers within each of said spaces during rotation of said rotor, said pump working chambers communicating with a corresponding one of said pump inlets or a corresponding one of said pump outlets, each of said vanes having an axial end edge;

engaging means formed on said axial end edge of each of said vanes;

arresting means disposed for selective engagement and disengagement with and from said engaging means, said arresting means being adapted to selectively assume a first position engaging with said engaging means in which it arrests each of said vanes in a retracted position in a corresponding one of said axial slits while said each vane is moving circumferentially in at least one of said spaces from a corresponding one of said pump inlets opening therein to a corresponding one of said pump outlets opening therein, and a second position disengaged from said engaging means in which said arresting means allows each of said vanes to slide on said camming inner peripheral surface of said cam ring while said each vane moves circumferentially in said at least one of said spaces;

control means for causing said arresting means to assume selectively said first position and said second position;

a drive shaft disposed in part within said pump housing for concentrically supporting said rotor, said rotor having one end face in which each of said axial slits opens at the axial end edge of a corresponding one of said vanes on which edge said engaging means is formed, one of said front and rear side blocks having one end face facing said one end face of said rotor, said arresting means comprising a first annular groove formed in said one end face of said rotor concentrically of said rotor, a second annular groove formed in said one end face of said one of said front and rear side blocks and aligned with said first annular groove, and a holder arranged in said second annular groove for axial displacement into and out of said first annular groove, said holder circumferentially extending at least in said at least one of said spaces between a corresponding one of said pump inlets and a corresponding one of said pump outlets, so that when said first position is selected, said holder is displaced into said first annular groove and into engagement with said engaging means of each of said vanes to arrest said each vane in said retracted position in the corresponding one of said axial slits, and wherein said holder has one end closer to said corresponding one of said pump inlets, another end closer to said corresponding one of said pump outlets, and a lateral side edge closer to said rotor, said holder being tapered in a manner such that said holder has a width gradually decreasing from said one end to said another end thereof and is projected from said second annular groove by an amount gradually increasing toward said one end thereof when said first position is selected.

2. A varible delivery vane compressor as claimed in claim 1, wherein said engaging means comprises a formed in said axial end edge of each of said vanes, said holder of said arresting means being adapted to be fitted in said notch when said first position is selected.

3. A variable delivery vane compressor as claimed in claim 1, wherein said camming inner peripheral surface of said cam ring has first and second portions at which it is in face-to-face contact with said outer peripheral surface of said rotor, said first and second portions being located, respectively, between said corresponding one of said pump inlets opening in said at least one of said spaces and one of said pump outlets opening in another one of said spaces and adjacent thereto at an upstream side thereof in a direction of rotation of said rotor, and between said corresponding one of said pump outlets opening in said at least one of said spaces and one of said pump inlets opening in said another one of said spaces or another one of said spaces and adjacent thereto at a downstream side thereof in said direction of rotation of said rotor, said holder circumferentially extending between said first and second portions of said camming inner peripheral surface.

4. A variable delivery vane compressor as claimed in claim 1, wherein said one of said front and rear side blocks has another end face remote from said rotor, said control means being mounted on said another end face of said one of said front and rear side blocks.

5. A variable delivery vane compressor as claimed in claim 4, wherein said second annular groove has a bottom face remote from said rotor, said one of said front and rear side blocks having a hole formed therein, said hole having one end opening in said another end face of said one of said front and rear side blocks and another end opening in said bottom face of said second annular groove, said control means comprising a rod formed of a magnetic material and movably fitted in said hole, said rod being coupled to said holder for movement therewith, an annular support secured to said another end face of said one of said front and rear side blocks, a solenoid supportedly wound on said annular support, and a spring disposed to apply to said rod a force counteracting a magnetic force produced by energization of said, solenoid.

6. A variable delivery vane compressor as claimed in claim 5, wherein said annular support has an end wall remote from said rotor and formed of a magnetic material, said spring comprising a compression spring interposed between said rod and said end wall, so that energization of said solenoid causes said rod to be magnetically displaced toward said end wall against the force of said spring.

* * * * *

UNITED STATES PATENT AND TRADEMARK OFFICE

CERTIFICATE OF CORRECTION

PATENT NO. : 4,522,573

DATED : June 11, 1985

INVENTOR(S) : Tsunenori SHIBUYA

It is certified that error appears in the above-identified patent and that said Letters Patent is hereby corrected as shown below:

COLUMN 8 (Claim 2), line 13, change "varible" to --variable--;

line 14, after "comprises a" insert --notch--;

COLUMN 8 (Claim 5), line 56, after "said" delete ",".

Signed and Sealed this

*Seventeenth* Day of *December 1985*

[SEAL]

*Attest:*

DONALD J. QUIGG

*Attesting Officer*

*Commissioner of Patents and Trademarks*